US007523920B2

(12) United States Patent
Semke

(10) Patent No.: US 7,523,920 B2
(45) Date of Patent: Apr. 28, 2009

(54) LENGTH-ADJUSTABLE CHAIN MOUNT AND STORAGE APPARATUS

(75) Inventor: Bryan T. Semke, Carlton, OR (US)

(73) Assignee: R.M. Wade & Co., Beaverton, OR (US)

( * ) Notice: Subject to any disclaimer, the term of this patent is extended or adjusted under 35 U.S.C. 154(b) by 151 days.

(21) Appl. No.: 11/603,379

(22) Filed: Nov. 21, 2006

(65) Prior Publication Data

US 2007/0144043 A1 Jun. 28, 2007

Related U.S. Application Data

(60) Provisional application No. 60/748,641, filed on Dec. 8, 2005.

(51) Int. Cl.
*B66D 3/00* (2006.01)

(52) U.S. Cl. ..... 254/382; 414/686; 37/903

(58) Field of Classification Search ..... 254/382, 254/323, 334, 279; 414/724, 912, 472, 686; 212/180; 37/403, 405, 903; 452/187, 189, 452/192

See application file for complete search history.

(56) References Cited

U.S. PATENT DOCUMENTS 634,578 A * 10/1899 Kaucher ..... 37/403
2,286,388 A * 6/1942 Smith ..... 254/372
3,145,857 A * 8/1964 Hayman et al. ..... 414/563
3,587,887 A * 6/1971 De Carli ..... 414/697
3,814,269 A * 6/1974 Blood et al. ..... 414/724
4,035,936 A * 7/1977 Avara ..... 37/396
4,114,855 A * 9/1978 Adamson, Jr. ..... 254/336
4,172,687 A * 10/1979 Schultz ..... 414/724
4,200,423 A * 4/1980 Sornsin ..... 414/724
4,226,331 A * 10/1980 Dumond ..... 212/258
4,242,035 A * 12/1980 Hornstein ..... 414/724
4,303,507 A * 12/1981 Smith ..... 209/252
4,329,103 A * 5/1982 Miller ..... 414/24.5
4,495,717 A 1/1985 Lockwood
4,561,199 A 12/1985 Lockwood
4,862,821 A * 9/1989 Ballantyne ..... 114/293
4,883,191 A * 11/1989 Christensen ..... 220/890
5,012,599 A * 5/1991 DeClair et al. ..... 37/444
5,520,498 A * 5/1996 DiBartolomeo ..... 414/680
5,845,893 A * 12/1998 Groves ..... 254/389
5,954,471 A * 9/1999 Cullen ..... 414/686
6,045,320 A * 4/2000 Cullen ..... 414/724
6,481,949 B1 11/2002 Cullen
6,547,508 B2 * 4/2003 Perry ..... 414/620
6,568,898 B2 * 5/2003 Nishimura et al. ..... 414/699

* cited by examiner

*Primary Examiner*—Emmanuel M Marcelo

(57) ABSTRACT

A length-adjustable chain mount and storage box apparatus is mounted to a vertically-movable support structure of a vehicle and arranged so that only a selected outer end length portion of a lift chain need to be pulled from the confines of a storage box whereupon the lift chain is supportingly secured at the selected extended length for connection of its free end to a load to be lifted by operation of the vertically movable structure of the vehicle. When the lifting operation is completed and the lift chain disconnected from the load, the extended portion of the lift chain is simply trained back into the storage box where it is stored without any interference to the normal operation of the vehicle and ready for immediate use when another lifting operation is required.

11 Claims, 4 Drawing Sheets

LENGTH-ADJUSTABLE CHAIN MOUNT AND STORAGE APPARATUS

This application claims benefit under 35 U.S.C. 119(e) of the priority filing date of U.S. Provisional application Ser. No. 60/748,641, Filed 8 Dec. 2005.

BACKGROUND OF THE INVENTION

This invention relates generally to apparatus arranged to store and secure one or more chains operatively on a vehicle for use in securing loads, lifting loads, towing, pulling loads and other chain uses on vehicles, and more particularly to apparatus arranged to operatively secure a lifting chain onto vertically movable lift structures of vehicles such as tractors, front end loaders, backhoes and other similar equipment, for operation of the vertically movable structure of the vehicle and lift chain supported thereon to lift objects secured to the free end of the lift chain.

As is well known by those familiar with the typical operations of tractors, front end loaders, backhoes and other vehicles it is a routine and frequent practice to rig a length of chain to the buckets of such vehicles, using whatever fixed structures or fixtures that might be available for securing the chain to suspend therefrom for attachment of its free end to an object to be lifted and/or transported by the vehicle. This requires that when a lift chain operation is desired, an operator must first obtain a lift chain from a storage box located on the vehicle or elsewhere and carry the heavy and awkward lift chain to the area of the bucket and then devote significant time and effort in manipulating the chain onto the bucket and devise suitable securement of the chain to the bucket, while also making accommodation for the adjustment of the length of the secured lift chain to that needed for the particular lifting operation without excess length which can diminish lifting capability of the lift chain as well as present a potential source of injury and damage in lifting operations.

U.S. Pat. Nos. 4,495,717 and 4,561,199 to Lockwood identify this use of lift chains on bucket assemblies of backhoes, and discloses a lift hook apparatus arranged for installation onto the bucket-supporting lift arm assembly of a backhoe to provide a dedicated mount structure for securing a lift chain or lift cable for a lifting operation. U.S. Pat. No. 6,481,949 to Cullen addresses the matter of utilizing the vertically movable front bucket structure of a front end loader or backhoe for lifting operations by providing a structurally complex and extensive crane attachment apparatus on the vertically movable front bucket structure of the vehicle.

Further, it is well known that chains are commonly attached to vehicles for uses of the chain in operations other than lifting. Such chain use operations commonly involve securing loads temporarily to vehicles for transport, securing chains to vehicles for pulling operations, such as stump pulling and dragging, towing operations and many others as is well understood by those familiar in the art of tractors, backhoes, and similar vehicles.

Accordingly, it can be seen that a need exists for a chain storage and securing device that can be simply and if desired, permanently mounted on tractors, loaders, backhoes and other vehicles without any interference to their normal operation and arranged to conveniently store a chain between uses and provide for withdrawal and operative locking securement of only a desired length of extending chain as is needed for use in desired chain operations, for subsequent return of the withdrawn portion of the chain to the storage compartment until another chain-use operation is required.

SUMMARY OF THE INVENTION

In its basic concept this invention provides a combination chain storage box and chain support mount assembly for mounting on either a fixed or a vertically movable support structure of tractors, loaders, backhoes and other vehicles without interference with the normal operation of the vehicle, the apparatus arranged to store at least one load-engaging chain until needed whereupon only the needed length of chain need be pulled from the storage box and operatively secured at the selected, extended length by engagement of a selected link of the chain with a link-engaging support mount on the assembly, for use of the extended, length of the chain in lifting and other operations, after which the extended portion of the lift chain may be returned back to the storage box until needed for a subsequent lifting or other operation.

It is by virtue of the foregoing basic concept that the principal objective of this invention is achieved; namely, the provision of a length-adjustable chain mount and chain storage apparatus that overcomes the limitations and disadvantages of arrangements provided heretofore.

Another object and advantage of the present invention is the provision of a chain mount and storage apparatus of the class described which is arranged to be mounted either removably or permanently on a vertically movable structure of a vehicle without in any way interfering with the normal, intended operation of the vehicle, for use of the chain as a lift chain.

Another object and advantage of the present invention is the provision of a chain mount and chain storage apparatus of the class described which eliminates the occurrence of twisting, knotting and inadvertent tangling of a lift chain during and inbetween uses.

Yet another object and advantage of the present invention is the provision of a chain mount and storage apparatus of the class described which completely avoids the need for the operator to lift, carry and manage the cumbersome burden of the full weight of a lift chain and the effort and time consuming procedure heretofore required in the normal procedure of securing a chain to a supporting structure of a vehicle for lifting, pulling, towing and load-securing operations, and disconnection, removal and storing of the chain after the chain operations are completed.

Still another object and advantage of the present invention is the provision of a chain mount and storage apparatus which provides for simple and facilitated adjustment of the length of a lift chain extended from the storage box and the positive, load bearing locking engagement of the lift chain at the selected length for increased versatility for connecting to a load to be lifted and for reduced potential of damage and injury resulting from improperly adjusted lifting chains.

A further object and advantage of the present invention is the provision of a chain mount and storage apparatus of the class described which may provide a pair of lift chains and a plurality of chain-engaging mount members arranged for securing the lift chains at selected laterally spaced apart distances from one another and at different individually selected lengths of extension as may be necessary in different lifting operations.

A still further object and advantage of the present invention is the provision of a chain mount and storage apparatus of the class described which is of simplified construction for economical manufacture and reliability and durability of use.

The foregoing and other objects and advantages of the present invention will appear from the following detailed description, taken in connection with the accompanying drawings of a preferred embodiment.

DESCRIPTION OF THE PREFERRED EMBODIMENT

Figure 1:
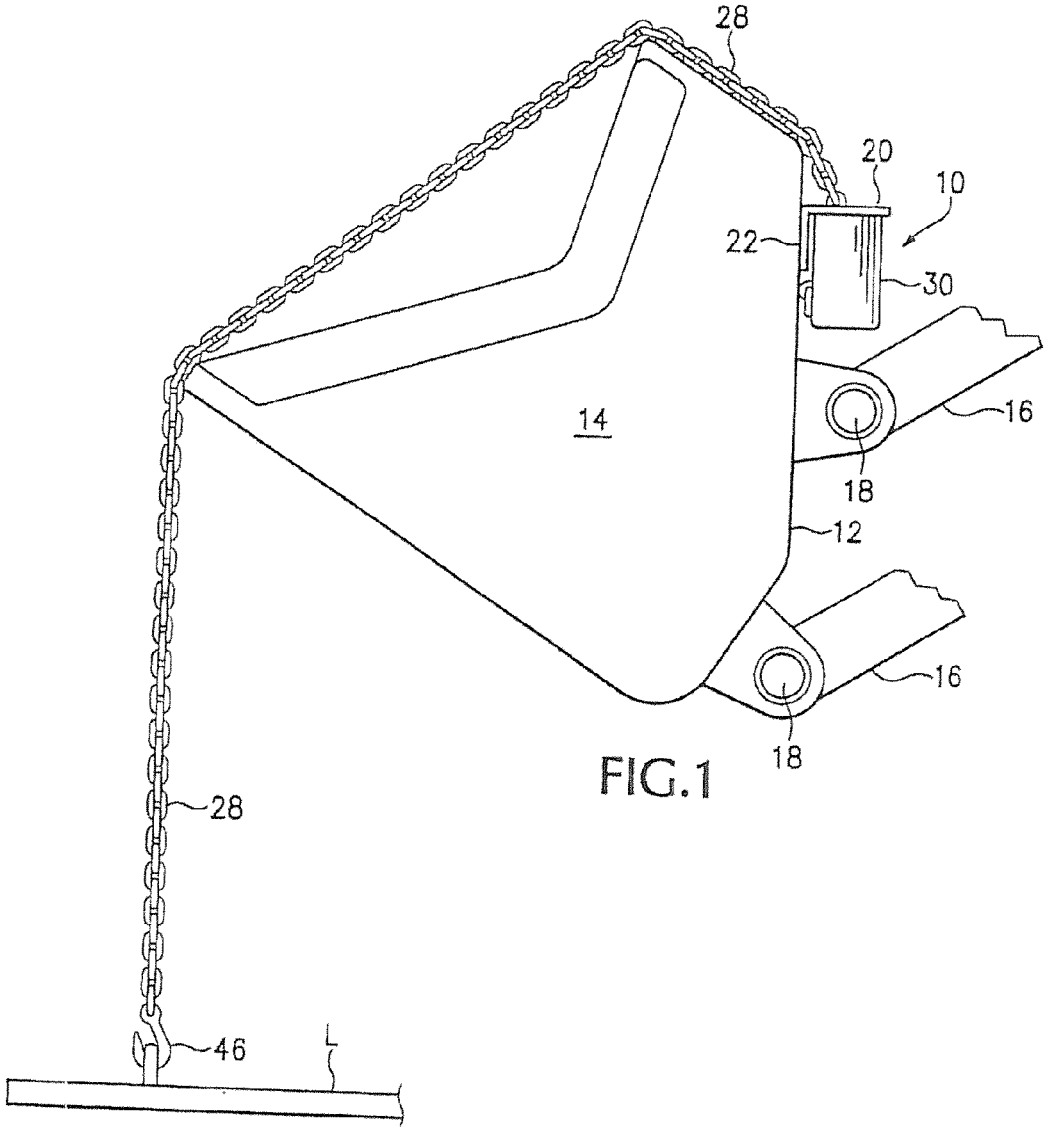
FIG. 1 is a fragmentary side elevational view of a length-adjustable chain mount and storage apparatus embodying features of the present invention in use mounted on the rear wall of the bucket on the vertically movable arm structure of a front end loader.

FIG. 1 illustrates a chain mount and storage apparatus 10 embodying features of the present invention in the form of a lift chain mount and storage apparatus 10 in use mounted substantially centrally on the rear wall 12 of the bucket 14 of a front end loader vehicle (not shown). As is well understood by those familiar with such vehicles, the front bucket 14 is mounted on a vertically movable support arm structure 16 provided to raise and lower the bucket on the vehicle and typically also provided to tilt the bucket on support arm pivots 18 as needed to fill and empty the bucket in conventional operation of the vehicle. As has also been described, it is common and frequent practice to use the vertically movable bucket assembly of the vehicle to lift and carry objects by securing a lifting chain to the bucket structure using any available or specialized hook feature fixture or other suitable, fixed structure that may be available on the bucket assembly to anchor the lift chain for suspension therefrom and connection of its free end to the object to be lifted.

This heretofore routine practice requires the operator to locate, retrieve and carry a heavy lift chain to the front end of the vehicle and manipulate the chain as needed to secure it to the vertically movable bucket structure for extension of the chain over the top of the bucket for suspension downwardly over its front end and connection of its free, working end to the object to be lifted. Once the lifting operation has been completed, the lift chain must then be disconnected, bundled up and carried back to its storage location. The present invention provides an apparatus arranged to avoid and obviate substantially all of the previously described laborious and time-consuming, but heretofore necessary, procedures in setting up a lift chain for use on such vehicles. As is well understood by those skilled in the use of such vehicles, chains are also secured to the bucket assembly for use in engaging loads to be pulled and towed by the vehicle, and for securing awkward, oversize loads to the bucket when such loads can't be carried securely within the bucket itself.

Figure 2:
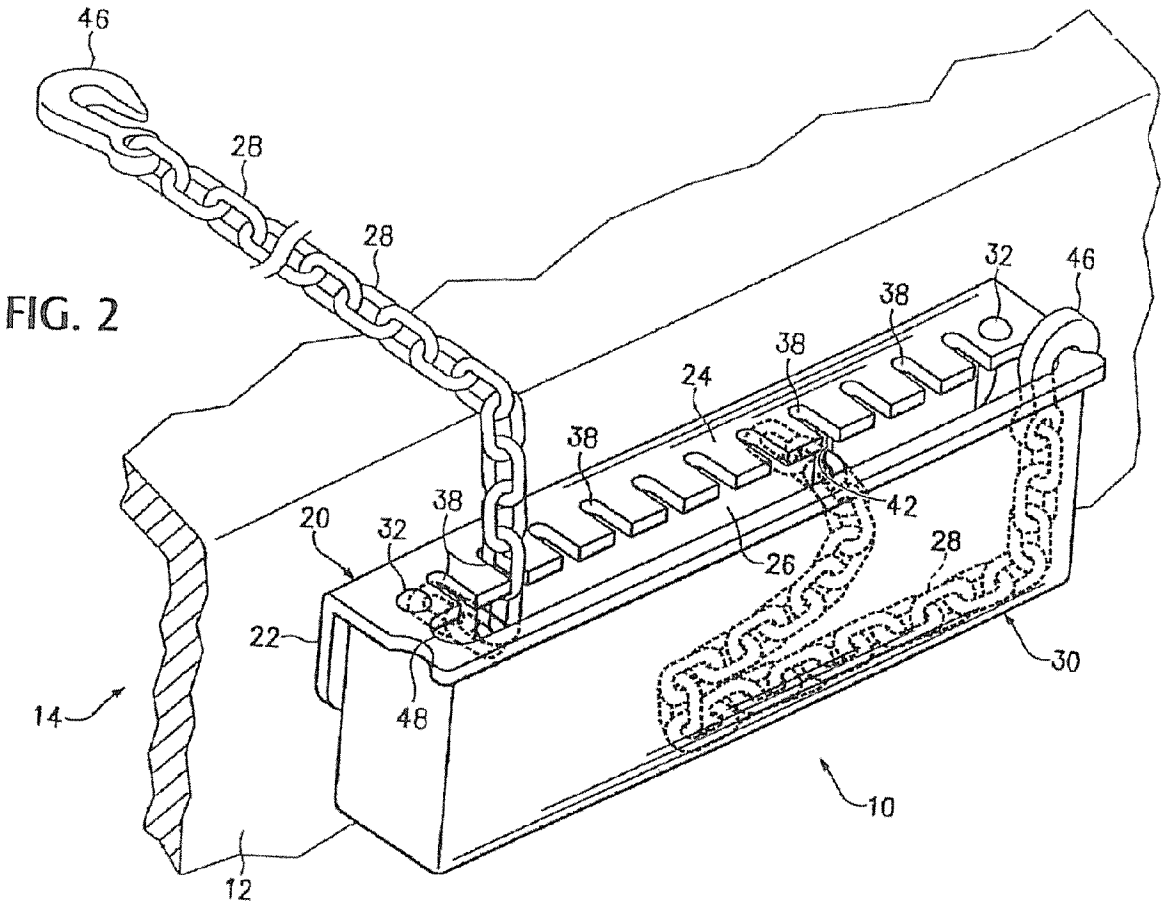
FIG. 2 is a fragmentary, foreshortened perspective view showing the apparatus of FIG. 1 in closer detail.
Figure 3:
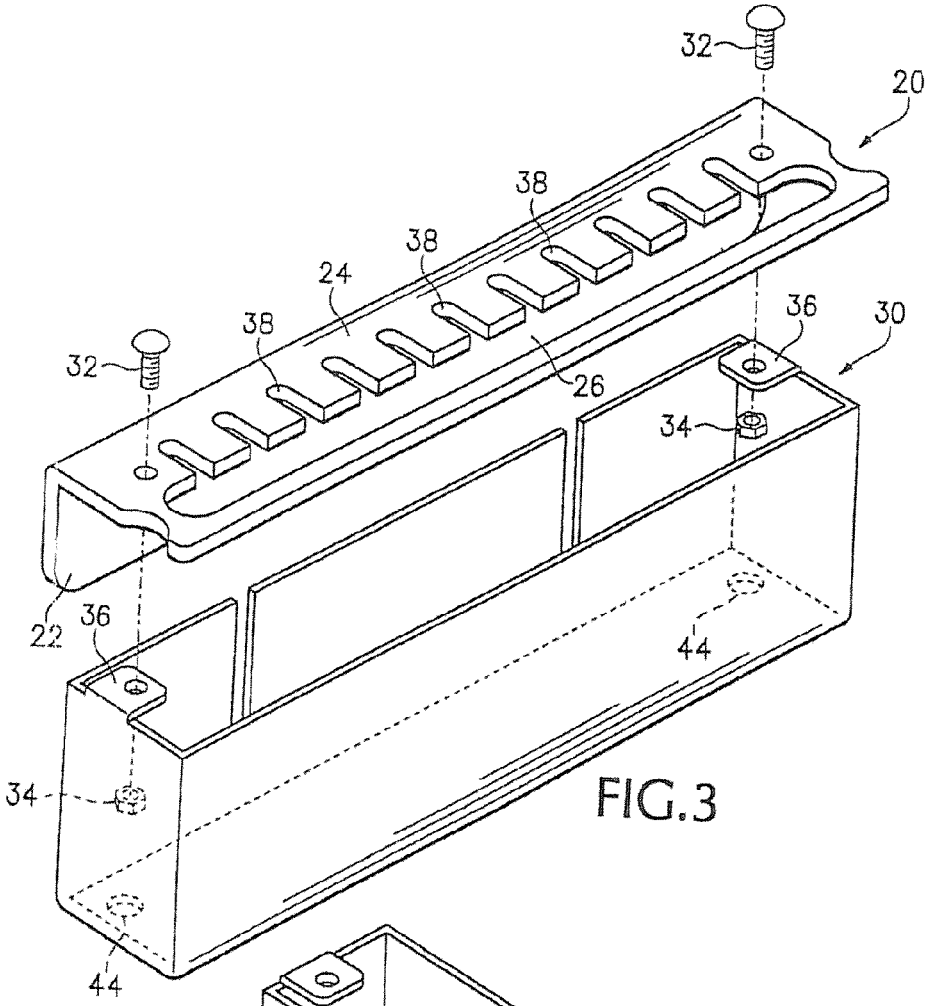
FIG. 3 is an exploded, perspective view of the chain engaging base member and the underlying chain storage box of the apparatus in separated condition to show its assembly.

FIG. 2 illustrates in close detail the lift chain mount and storage apparatus 10 of the invention mounted on the rear wall 12 of the front end loader bucket 14 shown in FIG. 1 of the drawings. FIG. 3 shows the apparatus 10 in exploded condition to more clearly illustrate the structural arrangement and assembly of the apparatus.

As will be understood in viewing FIGS. 2 and 3, in brief overview, the chain mount and storage apparatus of this invention includes a load-bearing chain support base member 20 having a mounting base 22 arranged for fixed, secure mounting to a selected supporting surface of a vertically movable structure of a vehicle. The chain support base member 20 also mounts a chain-engaging chain lock member 24 arranged to communicate with a chain passage opening 26 which permits free movement of at least one lift chain 28 being trained into and out of the hollow confines of a lift chain storage box member 30 supported on the chain support base member 20, the chain lock member arranged, in the embodiment illustrated, for selected engagement with an intermediate portion of a lift chain pulled out of the storage box 30 to releasably secure the lift chain at a selected length of extension therefrom and to support the tension applied thereagainst by the lift chain and object being lifted during lifting operations, as is readily apparent in viewing FIGS. 1 and 2.

With reference to the chain support base member 20, the mounting base member 22 is configured for mounted engagement to a selected support surface such as the rear wall 12 of a front end loader bucket 14 as reflected in FIGS. 1 and 2. Although the mounting base 22 of the chain support base member 20 may be arranged for mounting to the selected supporting surface by any suitable means such as by bolting (not shown) or by suitable clamp bracket (not shown) arranged for the particular purpose, those skilled in the art will recognize that the base mount member 22 is preferably welded to the selected supporting surface for the high strength, safety and security of the resulting mount.

The chain support base member 20 also supports means for releasably engaging an intermediate portion of a lift chain drawn out of the storage box to secure the chain at a fixed length of extension therefrom and for supporting the lifting tension of the extended lift chain during lifting operations. In the particular embodiment illustrated herein, this means supported on the chain support member 20 is provided by a link-engaging chain lock member 24 illustrated herein as a longitudinally elongated, laterally extending plate member 24 projecting outwardly from the mounting base portion 22. The plate member 24 is arranged to mount, as by bolts 32 and nuts 34 engaging mounting tabs 36, an underlying chain storage box member 30 having an open top end. The plate member 24 in the particular embodiment illustrated is provided with a plurality of open-ended, laterally-spaced chain link engaging lock slots 38 provided to removably receive and capture an intermediate portion of a selected link of a lift chain between adjacently-connected links of the chain as is shown in FIG. 2. A chain passage opening 26 communicates the open ends of the chain lock slots 38 and the interior confines of the chain storage box 30 for allowing a selected length of a lift chain to be pulled freely from the interior of the box and then permit movement of a selected link of the chain laterally into captured engagement with a selected lock slot member 38.

In the particular embodiment illustrated, the outwardly projecting plate 24 is configured to overlie and effectively cover the entire open top end of the underlying storage box member 30, and therefore the plate member 24 is formed with a chain passage opening 26 therethrough. Alternatively however, the plate member could be formed so as to terminate along the line of extension of the open ends of the lock slot members 38 and the chain passage opening then defined by the then-uncovered, open top of the storage box and the open space adjacent the open slots 38. The illustrated plate opening arrangement is however preferred in that the chain lock plate member 24 provides a durable wear surface for the chain to slide against when the chain is pulled out of and trained back into the inner confines of the storage box member which, since it only needs to simply house the chain carried therein, does not require the substantial construction that is required of the load-bearing chain support base member 20, mounting base 22 and chain-engaging lock member 24.

With the load-bearing chain support base member 20 securely and rigidly mounted on a selected support surface of a vertically-movable structure of a vehicle, the assembly of the length-adjustable chain lift mount and storage apparatus of the invention is completed as follows: The inner terminal end of a lift chain is extended through the chain passage opening and into the interior confines of the storage box member 30 which is yet to be mounted on the support base member 20. The inner terminal end of the lift chain is then preferably secured in the box to prevent the lift chain from being unintentionally pulled entirely out of the storage box. Although the inner end may be secured permanently as by welding, it is preferably secured in a manner which allows it to be released, in the event that the chain needs to be removed for repair or replacement due to wear, breakage or other reasons.

Figure 4:
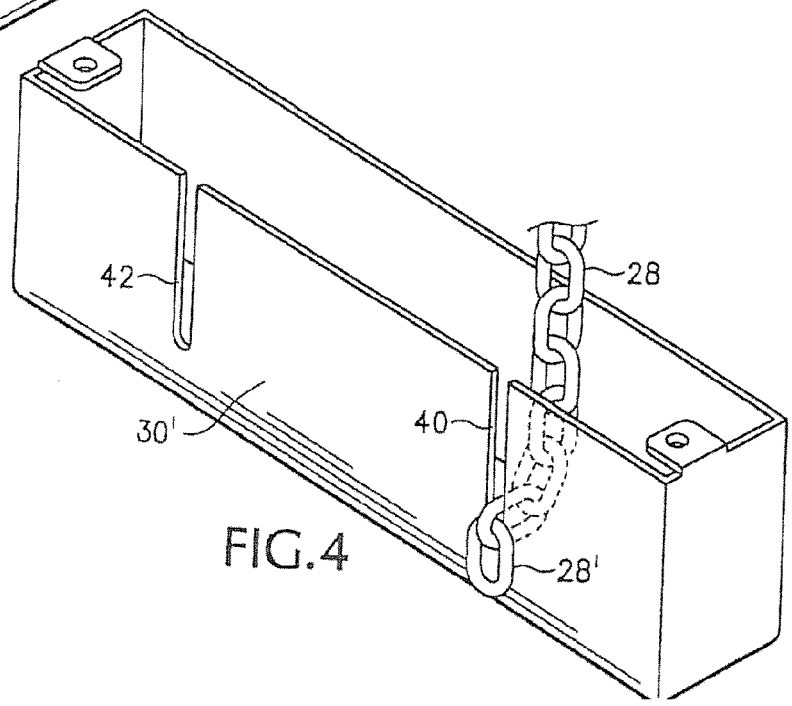
FIG. 4 is a fragmentary rear perspective view of the chain storage box member and showing a preferred, simplified arrangement for securing the inner terminal end of a chain against unintentional removal from the confines of the storage box.

A preferred arrangement for releasably securing the inner end of a chain within the box is shown in FIG. 4 wherein a vertical chain link-capturing slot 40 is provided in the back wall 30' of the box member extending downwardly from the open top edge of the wall. An intermediate portion of the link adjacent the final, inner end link 28' of the lift chain 28 is inserted into captured engagement within the slot as shown. Abutment of the final link 28 of the chain against the back wall 30' of the box captures the chain within the slot as seen clearly in FIG. 4.

It will be understood that, once the box is mounted to the overlying plate member 24, the plate covers the open end of the slot 40 and thus prevents separation of the engaged link vertically through the open end of the slot. This arrangement provides an extremely simple and efficient manner for securing the inner end of the lift chain releasably within the interior confines of the storage compartment. With the inner end of the lift chain confined, the lift chain is prevented from becoming tangled, twisted or otherwise fouled during repeated uses and by the jostling encountered while being stored in the storage box during normal operations of the vehicle. A second link-engaging slot 42 is shown in FIG. 4 for securing the inner end of a second lift chain if provided.

With the inner end of the chain thus secured, the box member is then mounted to the support base member 20, as by securement bolts 32 and nuts 34. Openings 44 provided through the bottom wall of the storage box permit engagement of the nuts 34 by an appropriate tightening tool, and also serve as drain holes for allowing the interior of the box to drain of any rainwater, etc.

The remaining length of lift chain is then trained into the interior confines of the box 30. Typically, as shown, the outer, working end of the lift chain mounts a selected lift chain end fitting such as a lifting hook 46, and is preferably retained in a stored condition outside of the confines of the box, as by engaging the lifting hook 46 on the lip of the base support member as shown in FIG. 2. Hook seats 48 or other means for securing the outer working end of the chain in stored condition outside of the confines of the box for ready access may be provided as desired or needed for the purpose.

With the assembled length-adjustable lift chain mount and storage apparatus thus installed on a vehicle, the vehicle may be operated in its conventional functions without any limitation or interference imposed by the installed apparatus of this invention. When a lifting operation is to be undertaken, the operator simply grasps the lifting hook 46 on the end of the lift chain and pulls a desired length of chain 28 out of the storage box 30 and passes the extending chain forwardly over the bucket 14 of the vehicle and downwardly over its front end.

The load L to be lifted is then connected to the lifting fixture 46 on the outer, free working end of the lift chain, and the operator then simply pulls on the lift chain in the reverse direction to remove any undesirable slack, the excess length of chain returning back into the interior confines of the storage box. The operator then moves a selected link of the lift chain into captured reception in a selected chain lock slot 38 as is seen in FIG. 2. The vehicle is then ready to be operated to lift and carry the load L. If the apparatus contains a second lifting chain, and the particular lifting operation makes it advisable to utilize the second lift chain for necessary stability, etc., the foregoing steps will have been conducted with the second lift chain preliminary to the lifting operation.

After the lifting operation has been completed and the lift chain is disconnected from the load, the operator simply pulls on the extended lift chain, dragging it back and up over the bucket and directing the chain to fall by gravity freely back through the open top of the box into the confines of the storage box 30, and secures the free, outer terminal end of the chain in seated condition where it will be retained until the next lifting operation. The vehicle and operator are thus immediately ready to resume conventional operation of the vehicle, and the lift chain apparatus is ready for immediate use the next time it is needed.

Figure 5:
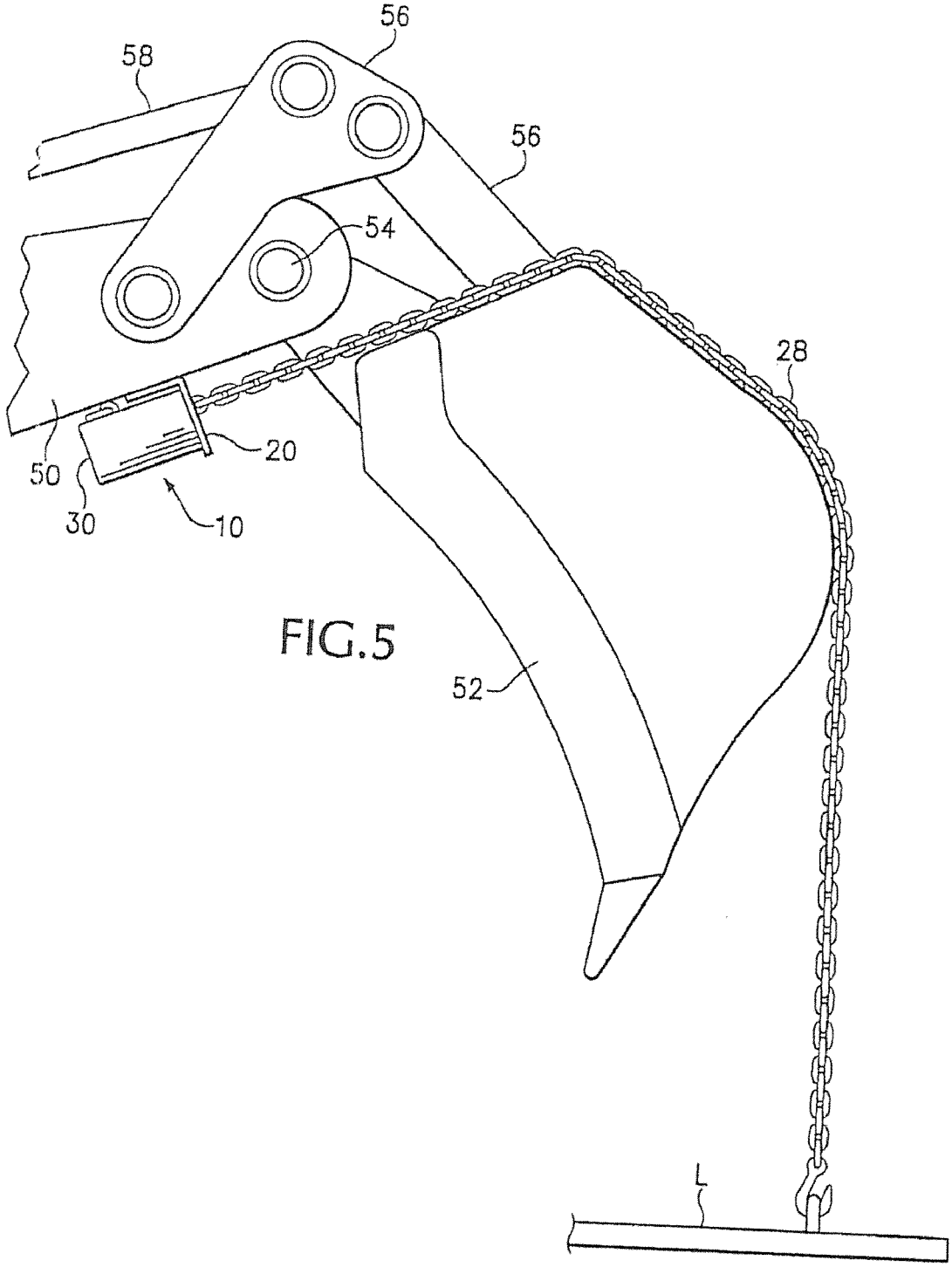
FIG. 5 is a fragmentary side elevational view showing the chain mount and storage apparatus of this invention in a condition of use mounted on the boom arm structure of a backhoe to illustrate another, alternative mounting arrangement on a vertically-movable structure of a vehicle.

FIG. 5 illustrates that the apparatus of this invention is not limited to installation only on front end bucket structures of tractors and loader vehicles. In this, the previously-described apparatus 10 is shown operatively mounted on the vertically-movable boom arm 50 of a backhoe (not shown). As is understood by those skilled in the art, the boom arm 50 of backhoes typically mounts a digging bucket 52 by a pivot mount 54, the bucket being articulated by a pivotal link arm assembly 56 operatively engaged by a hydraulic cylinder arm 58.

In an application such as this, since backhoe buckets are primarily intended for trenching and earth digging functions, installation of the apparatus of the invention on the backhoe bucket 52 would be impractical, both since the bucket structure is reversed and because the installation would interfere with and be physically impacted by the earth-digging operations done by backhoe buckets. Therefore, the apparatus is installed on the supporting boom arm 50 for extension of the lift chain over the top and rear end of the digging bucket as shown. This mounting arrangement also allows for unhindered bucket replacement and swapping as is a common occurrence in routine backhoe operations. It also allows the backhoe to be used for lift chain operations when implements other than buckets are installed on the boom arm. Such implements used on backhoes include jackhammer devices, tamping devices and many other implements arranged for operative mounting on the boom arm.

Those knowledgeable in the operation of the vehicles represented in FIGS. 1 and 5 of the drawings will recognize that the lift chains 28 may alternatively be extended around the buckets and an oversize or awkward load (not shown) carried by the buckets to secure the load to the bucket for safety, etc. Also, the lift chains may be extended to a load (not shown) to be engaged for pulling or towing operations of the vehicle.

From the foregoing it will be apparent to those skilled in the art that many various changes other than those already discussed may be made in the size, shape, type, number and arrangement of parts described hereinbefore without departing from the spirit of this invention and the scope of the appended claims. For example, although the link-engaging chain lock member 24 has been shown and described herein as a plate member formed with a plurality of laterally spaced lock slots arranged to accommodate desired lateral positioning of the extended portion of a secured lift chain, and to accommodate use and relative spacing of two lift chains in lifting operations, only one link-engaging lock member need be provided as a minimum.

Also, although one preferred arrangement of a means for capturing and engaging a selected link of a lift chain for locking the chain at a desired length of extension has been illustrated herein in the form of the lock slots 38, other link-engaging and chain-engaging lock arrangements may be alternatively provided for the purpose of releasably engaging an intermediate portion of the lift chain to releasably lock the chain at a selected length of extension therefrom for supporting the chain and load during lifting operations.

Additionally, although the chain mount and storage apparatus of this invention has been described herein as preferably being mounted on a vertically-movable structure of a vehicle to enable use of the apparatus for load lifting operations upon operation of the vertically-movable structure of the vehicle, it is to be understood that the chain mount and storage apparatus is in no way limited to mounting only on a vertically-movable structure of a vehicle for providing lift chain functions. For example, the described apparatus may alternatively be mounted on a vehicle bumper or other frame support member such as the frame of a flat bed truck, trailer or railroad car for extension of the chain for engagement with a load to be tied down or otherwise secured, or for extension to a load to be pulled or towed by the vehicle and other chain operations as may be needed or desired.

Having thus described my invention and the manner in which it may be used, I claim:

1. A chain mount and chain storage apparatus for vehicles, the chain mount and storage apparatus comprising:

a) a chain support base member arranged for secure mounting on a support structure of a vehicle, b) at least one load-engaging chain, each at least one chain having a first terminal end and a second, terminal end arranged for connection to a load, c) a chain storage box member supported on the chain support base member, the storage box member having substantially hollow interior confines arranged for holding the at least one chain for storage between uses, d) a chain passage opening communicating with the interior confines of the storage box member and arranged to permit at least a portion of the at least one chain to be withdrawn freely out of the interior confines of the chain storage box member to connect to a load, and e) chain engaging lock means on the chain support base member for releasably engaging a given portion of the at least one chain to secure the chain at a fixed length of extension from the chain engaging lock means and to support the extended chain and a load connected to the chain, the chain engaging lock means comprising a plurality of laterally spaced apart, chain link-engaging lock slots on the chain support base member arranged to engage and releasably secure the at least one chain.

2. The chain mount and chain storage apparatus of claim 1 wherein the chain storage box member holds a pair of individual chains for storage, and a selected link of each chain may be engaged with a different, selected laterally spaced apart lock slot whereby to position the pair of secured chains for extension therefrom in selected, laterally, spaced apart condition.

3. The chain mount and storage apparatus of claim 1 wherein the chain storage box member is arranged with an open top end, and the chain engaging lock means on the chain support base member comprises a plate member arranged to substantially overlie at least a portion of the open top end of the storage box member, the plate member arranged with at least one chain link-engaging lock slot, whereby the at least one chain may be pulled freely from the interior of the storage box member through the open top end and a selected link of the chain may be engaged with the link-engaging lock slot to secure the chain at a given length of extension from the link-engaging lock slot and to support the chain during load-engaging operation.

4. The chain mount and chain storage apparatus of claim 1 wherein the first terminal end of the at least one load engaging chain is secured to the storage box member to retain the chain in the interior confines of the box and to prevent inadvertent withdrawal and separation of the chain from the storage box member.

5. An apparatus for use with a structure that couples with an object via a chain including a plurality of interlocking links and that pulls on the chain to move the object, comprising:

an anchor that is mounted to the structure and that defines a plurality of laterally spaced slots for receiving the chain to anchor the chain to the structure via the anchor; and a container that is selectively mounted to the anchor and that defines a cavity for storing the chain.

6. The apparatus of claim 5, wherein each slot of the plurality of laterally spaced slots has a lateral dimension sized to receive a first link of the chain and to block a second link that is interlocked to the first link.

7. The apparatus of claim 5, wherein the anchor defines a laterally extending aperture that is adjacent to the plurality of laterally spaced apart slots and that is in open communication with the plurality of laterally spaced apart slots to provide a path for the chain to move from one slot to another slot.

8. The apparatus of claim 5, wherein the container is configured to selectively mount to the anchor with a threaded fastener.

9. An apparatus for moving a load using a moving structure, comprising:

an elongate tension bearing member for operatively connecting to the load;

a container that defines a cavity to store the elongate tension bearing member and that includes a first slot, the first slot being configured to receive the elongate tension bearing member to secure the elongate tension bearing member to the container; and an anchor that is rigidly connected to the moving structure and to which the container may selectively mount, the anchor including a second slot to receive the elongate tension bearing member to anchor the elongate tension bearing member to the moving structure.

10. The apparatus of claim 9, wherein the anchor includes a plurality of laterally spaced second slots.

11. The apparatus of claim 9, wherein the elongate tension bearing member includes a chain having a plurality of interlocking links.

* * * * *